US012722048B2

(12) United States Patent
Kodaka

(10) Patent No.: US 12,722,048 B2
(45) Date of Patent: Sep. 1, 2026

(54) GOLF CLUB HEAD

(71) Applicant: Sumitomo Rubber Industries, Ltd., Hyogo (JP)

(72) Inventor: Jun Kodaka, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 112 days.

(21) Appl. No.: 18/339,941

(22) Filed: Jun. 22, 2023

(65) Prior Publication Data

US 2024/0017133 A1 Jan. 18, 2024

(30) Foreign Application Priority Data

Jul. 12, 2022 (JP) ..... 2022-112071

(51) Int. Cl.
*A63B 53/04* (2015.01)
*A63B 53/08* (2015.01)

(52) U.S. Cl.
CPC ..... *A63B 53/0433* (2020.08); *A63B 53/0408* (2020.08); *A63B 53/08* (2013.01); *A63B 53/0466* (2013.01); *A63B 2053/0491* (2013.01)

(58) Field of Classification Search
CPC . A63B 53/0433; A63B 53/0408; A63B 53/08; A63B 53/0466; A63B 2053/0491
See application file for complete search history.

(56) References Cited

U.S. PATENT DOCUMENTS 4,085,934 A * 4/1978 Churchward ..... A63B 53/04 473/338
5,395,113 A * 3/1995 Antonious ..... A63B 53/04 473/324
6,033,318 A * 3/2000 Drajan, Jr. ..... A63B 60/54 473/309
6,254,494 B1 * 7/2001 Hasebe ..... A63B 53/04 473/345
6,776,723 B2 * 8/2004 Bliss ..... A63B 60/00 473/345
7,435,191 B2 * 10/2008 Tateno ..... A63B 60/02 473/346
8,182,365 B2 * 5/2012 Wada ..... A63B 53/0466 473/344
8,900,070 B1 * 12/2014 Dawson ..... A63B 60/02 473/335
9,802,086 B2 * 10/2017 Kato ..... A63B 53/0466
(Continued)

*Primary Examiner* — William M Pierce
(74) *Attorney, Agent, or Firm* — Studebaker Brackett PLLC

(57) ABSTRACT

A golf club head includes a face portion including a hitting face, a sole portion, a crown portion, and a hosel portion. The sole portion includes a center thin-wall part and an outer thick-wall part that is formed on a sole outer edge side of the center thin-wall part and is thicker than the center thin-wall part. The outer thick-wall part includes a first thick-wall part that is formed over a region including a position of a center of gravity of the head in a face-back direction, and a second thick-wall part that is positioned on a back side of the first thick-wall part and is thicker than the first thick-wall part. The outer thick-wall part of the sole portion may further include a third thick-wall part that is positioned on the back side of the second thick-wall part and is thinner than the second thick-wall part.

22 Claims, 9 Drawing Sheets

(56) References Cited

U.S. PATENT DOCUMENTS 10,639,524 B2 * 5/2020 Penney ..... A63B 53/06
10,773,135 B1 * 9/2020 Hoffman ..... A63B 60/02
11,083,935 B2 * 8/2021 Jertson ..... A63B 53/0466
11,541,283 B1 * 1/2023 Evans ..... A63B 53/04
11,654,336 B2 * 5/2023 Penney ..... A63B 60/52
473/307
11,998,810 B1 * 6/2024 Day ..... A63B 53/0416
2007/0049405 A1 * 3/2007 Tateno ..... A63B 53/0466
473/345
2007/0049406 A1 * 3/2007 Tateno ..... A63B 60/02
473/345
2007/0049407 A1 * 3/2007 Tateno ..... A63B 60/02
473/345
2008/0220894 A1 * 9/2008 Matsunaga ..... A63B 53/0466
473/346
2011/0039636 A1 * 2/2011 Cackett ..... A63B 60/52
473/345
2012/0157229 A1 * 6/2012 Takechi ..... A63B 53/0466
473/345
2012/0302368 A1 * 11/2012 Nishio ..... A63B 53/0466
473/345
2012/0322580 A1 * 12/2012 Wada ..... A63B 53/0466
473/346
2013/0116065 A1 * 5/2013 Yamamoto ..... A63B 53/0466
473/345
2013/0130831 A1 * 5/2013 Morales ..... A63B 53/047
29/505
2014/0106903 A1 * 4/2014 Nakamura ..... A63B 53/0466
473/346
2014/0274457 A1 * 9/2014 Beach ..... A63B 53/0412
473/335
2015/0094165 A1 * 4/2015 Cole ..... A63B 53/0466
473/332
2016/0023062 A1 * 1/2016 Willett ..... A63B 60/52
473/329
2016/0023063 A1 * 1/2016 Willett ..... A63B 60/00
29/401.1
2016/0096083 A1 * 4/2016 Boggs ..... A63B 60/00
473/324
2016/0354655 A1 * 12/2016 Kato ..... A63B 53/0466
2016/0354656 A1 * 12/2016 Kato ..... A63B 53/0466
2017/0151472 A1 * 6/2017 Beach ..... A63B 60/00
2017/0319914 A1 * 11/2017 Jertson ..... A63B 53/047
2018/0001159 A1 * 1/2018 Mizutani ..... A63B 53/0466
2018/0001170 A1 * 1/2018 Mizutani ..... A63B 60/52
2018/0140906 A1 * 5/2018 Stokke ..... A63B 53/0466
2018/0185714 A1 * 7/2018 Jertson ..... A63B 53/0475
2018/0345099 A1 * 12/2018 Harbert ..... A63B 53/0433
2020/0122003 A1 * 4/2020 Milleman ..... A63B 60/006
2020/0206586 A1 * 7/2020 Yamamoto ..... A63B 53/0466
2020/0298072 A1 * 9/2020 Morales ..... A63B 53/0466
2020/0298073 A1 * 9/2020 Beach ..... A63B 60/52
2020/0338403 A1 * 10/2020 Mizutani ..... A63B 53/0466
2020/0391087 A1 * 12/2020 Su ..... A63B 53/0429
2022/0072391 A1 * 3/2022 Mizutani ..... A63B 60/02
2023/0014268 A1 * 1/2023 Jertson ..... A63B 53/0466
2023/0139568 A1 * 5/2023 Harbert ..... A63B 60/48
473/282
2024/0149118 A1 * 5/2024 Schier ..... A63B 53/0408

* cited by examiner

GOLF CLUB HEAD

CROSS REFERENCE TO RELATED APPLICATION

The present application claims priority to Japanese Patent Application No. 2022-112071 filed on Jul. 12, 2022. The entire contents of this Japanese Patent Application are hereby incorporated by reference.

BACKGROUND

Technical Field

The present disclosure relates to golf club heads.

Description of the Related Art

There has been proposed a golf club head that includes a sole portion having adjusted wall thickness. JP2017-293A (US2016/0354655A1) discloses a golf club head that includes a sole portion having: a first thin-wall portion; and a first thick-wall portion that extends from the toe side of the first thin-wall portion to the heel side of the first thin-wall portion via the back side and is thicker than the first thin-wall portion. This golf club head can improve a lateral moment of inertia.

SUMMARY

There has been demand for a head having a higher performance. The inventor of the present disclosure has found that a novel wall-thickness distribution in a sole portion can provide advantageous effects different from conventional ones.

One of the objects of the present disclosure is to provide a golf club head that has an improved performance achieved by a wall-thickness distribution of a sole portion.

In one aspect, a golf club head includes a face portion that includes a hitting face, a sole portion, a crown portion, and a hosel portion. The sole portion includes a center thin-wall part that is formed over a region including a geometric center of the sole portion, and an outer thick-wall part that is formed on a sole outer edge side of the center thin-wall part and has a wall thickness greater than a wall thickness of the center thin-wall part. The outer thick-wall part includes a first thick-wall part that is formed over a region including a position of a center of gravity of the head in a face-back direction, and a second thick-wall part that is positioned on a back side of the first thick-wall part and has a wall thickness greater than a wall thickness of the first thick-wall part.

DESCRIPTION OF THE PREFERRED EMBODIMENTS

Hereinafter, embodiments will be described in detail with appropriate references to the accompanying drawings.

In the present disclosure, a reference state, a reference perpendicular plane, a toe-heel direction, a face-back direction, an up-down direction, and a face center are defined as follows.

Figure 9:
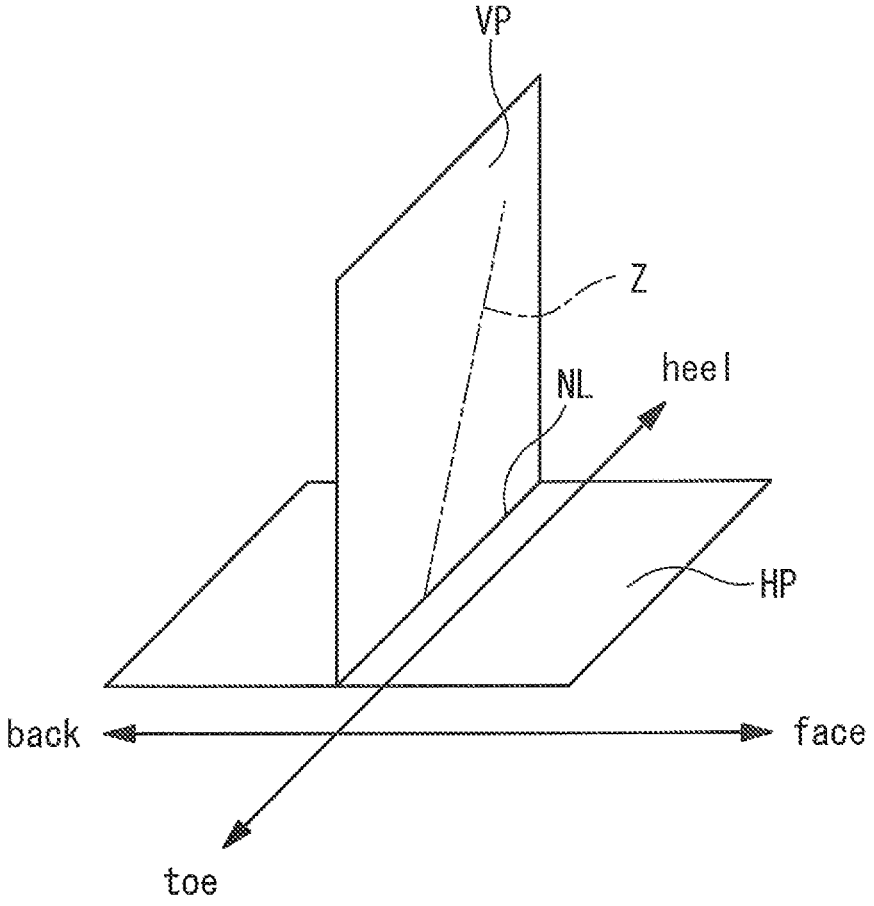
FIG. 9 is a conceptual diagram for illustrating a reference state.

The reference state is a state where a head is placed at a predetermined lie angle on a ground plane HP. As shown in FIG. 9, in the reference state, a shaft axis line Z lies on (is contained in) a plane VP that is perpendicular to the ground plane HP. The shaft axis line Z is the center line of a shaft. The shaft axis line Z usually coincides with the center line of a hosel hole. The plane VP is defined as the reference perpendicular plane. The predetermined lie angle is shown in a product catalog, for example.

There has been known a club in which its loft angle, lie angle and face angle can be adjusted by, for example, changing a position of rotation of a sleeve provided at a tip portion of a shaft. In such a club, the sleeve can be detachably fixed to the head with a fixing means such as a screw. For this reason, in this club, the shaft is attachable to/detachable from the head. In a club having such an attachable/detachable mechanism, all adjustable items are set to be neutral when the club is in the reference state. The term "neutral" means the center of the range of adjustment. The club of the present disclosure may include such an attachable/detachable mechanism.

In the reference state, a face angle is 0'. That is, in a planar view of a head as viewed from above, a line normal to its hitting face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 9). A toe side in the toe-heel direction is also simply referred to as "toe side". A heel side in the toe-heel direction is also simply referred to as "heel side".

In the present disclosure, the face-back direction is a direction that is perpendicular to the toe-heel direction and is parallel to the ground plane HP. A face side in the face-back direction is also simply referred to as "face side". The face side is also referred to as "front side". A back side in the face-back direction is also simply referred to as "back side". The back side is also referred to as "rear side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center Fc is determined in the following manner. First, a point Pr is selected roughly at the center of a hitting face in the up-down direction and the toe-heel direction. Next, a plane that passes through the point Pr, extends in the direction of a line normal to the hitting face at the point Pr, and is parallel to the toe-heel direction is determined. An intersection line between this plane and the hitting face is drawn, and a midpoint Px of this intersection line is determined. Next, a plane that passes through the midpoint Px, extends in the direction of a line normal to the hitting face at the midpoint Px, and is parallel to the up-down direction is determined. An intersection line between this plane and the hitting face is drawn, and a midpoint Py of this intersection line is determined. Next, a plane that passes through the midpoint Py, extends in the direction of a line normal to the hitting face at the midpoint Py, and is parallel to the toe-heel direction is determined. An intersection line between this plane and the hitting face is drawn, and a midpoint Px of this intersection line is newly determined. Next, a plane that passes through this newly-determined midpoint Px, extends in the direction of a line normal to the hitting face at this midpoint Px, and is parallel to the up-down direction is determined. An intersection line between this plane and the hitting face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center Fc.

Figure 1:
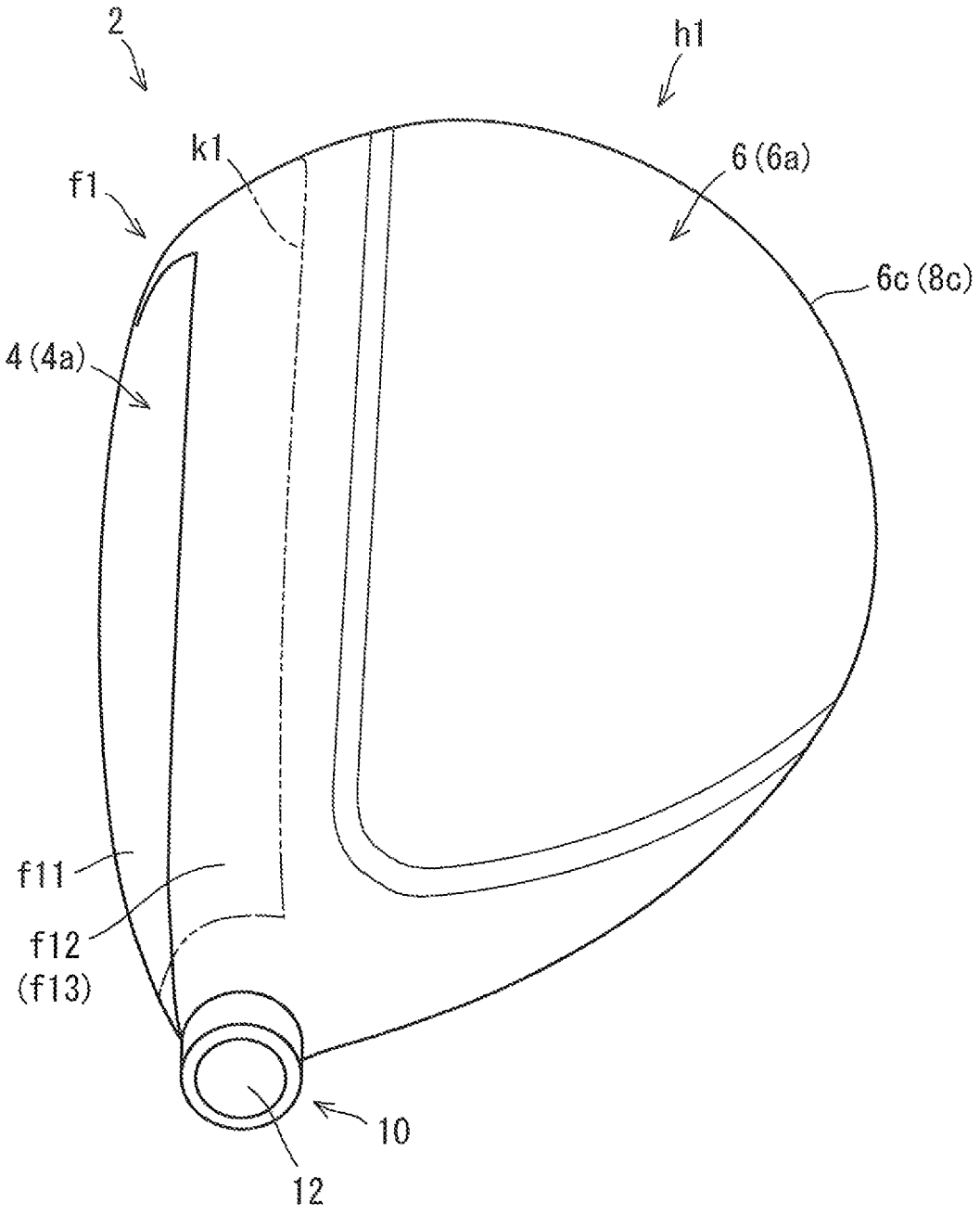
FIG. 1 shows a plan view of a golf club head according to an embodiment.
Figure 2:
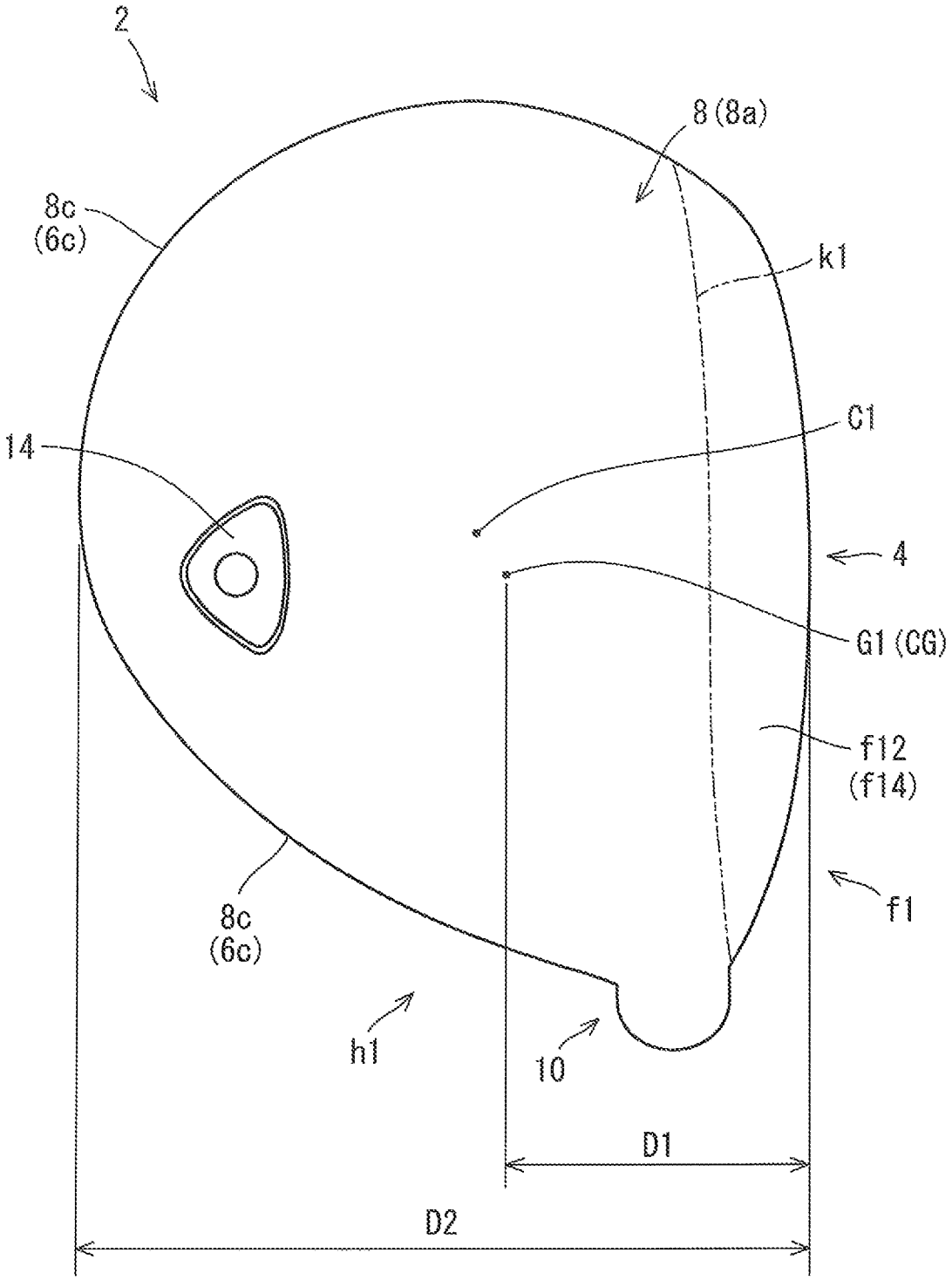
FIG. 2 is a bottom view of the golf club head in FIG. 1.
Figure 3:
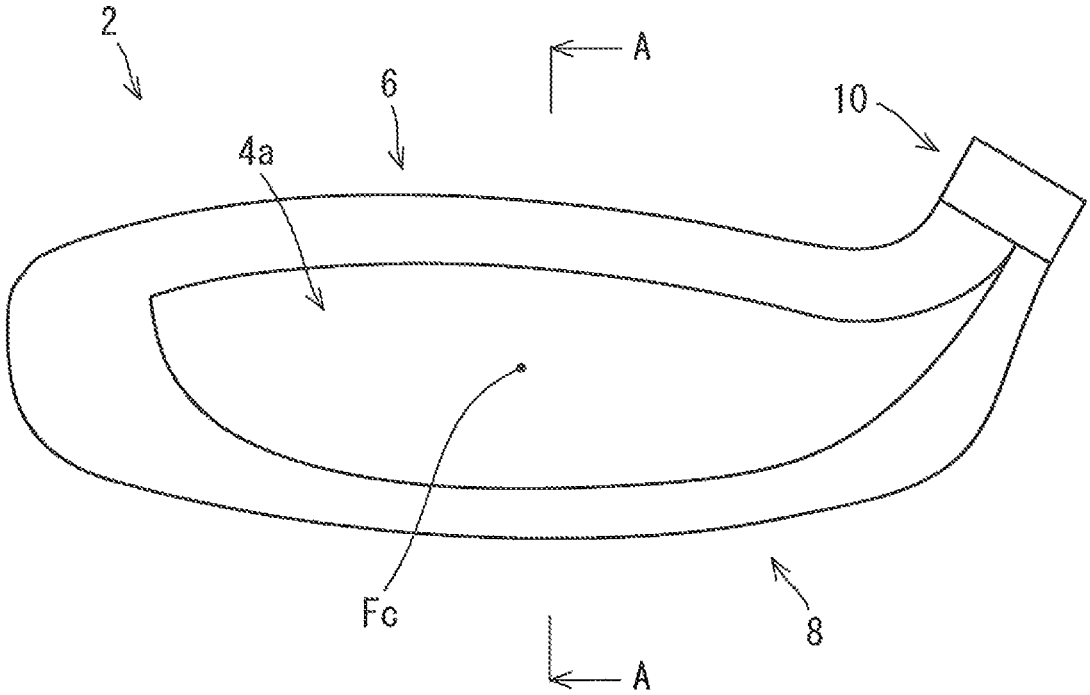
FIG. 3 is a front view of the golf club head in FIG. 1.
Figure 4:
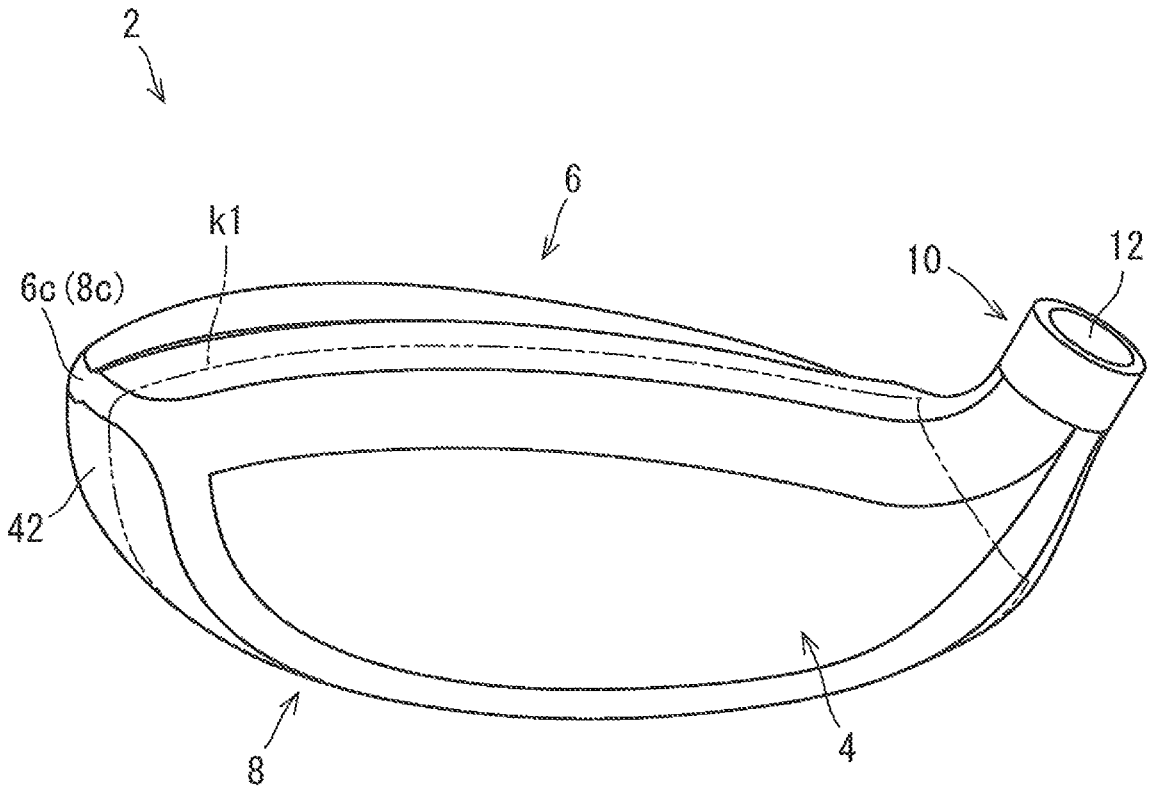
FIG. 4 is a perspective view of the golf club head in FIG. 1.
Figure 5:
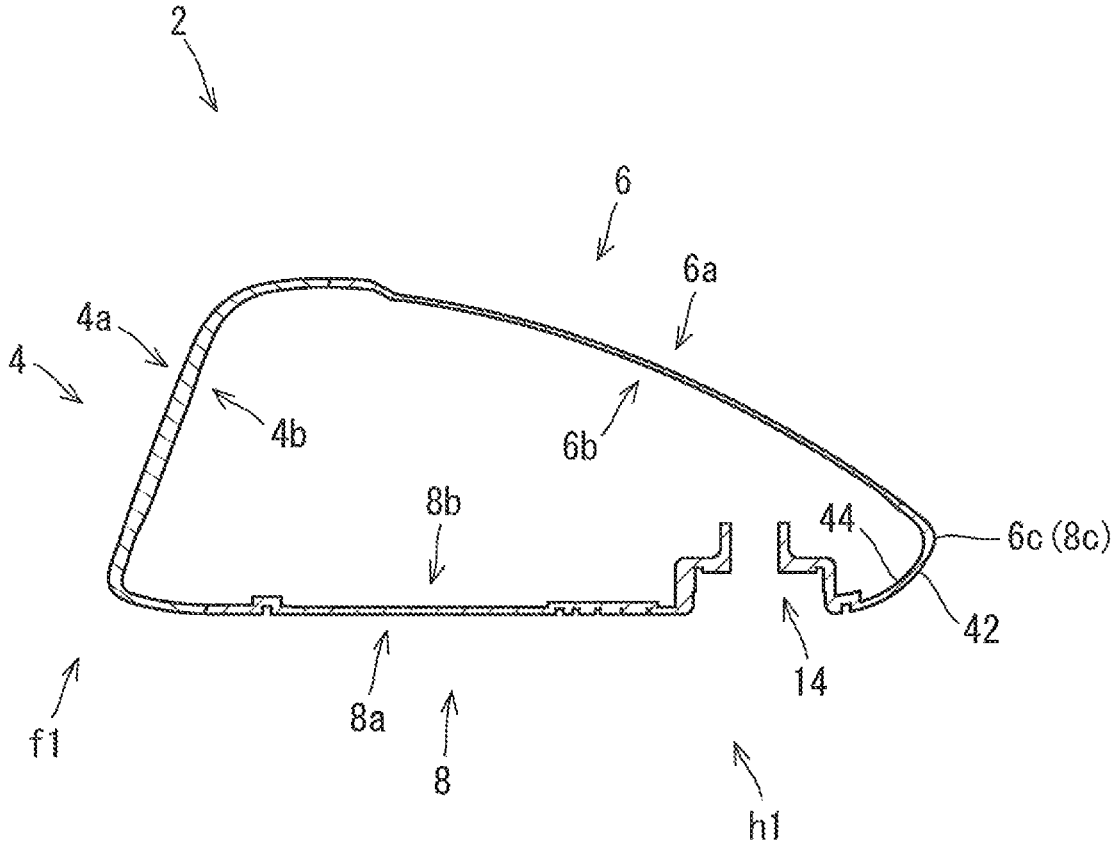
FIG. 5 is a cross-sectional view taken along line A-A in FIG. 3.

FIG. 1 is a plan view of a golf club head 2 according to one embodiment as viewed from a crown side. FIG. 2 is a bottom view of the head 2 as viewed from a sole side. FIG. 3 is a front view of the head 2 as viewed from a face side. FIG. 4 is a perspective view of the head 2. FIG. 5 is a cross-sectional view taken along line A-A in FIG. 3.

The head 2 is a wood-type head. The head 2 is a fairway wood type head. The head 2 has a hollow structure. The head 2 is formed by joining a face member f1 having a cup shape to a head body h1. The joining is performed by welding. A boundary line k1 between the face member f1 and the head body h1 is indicated by a two-dot chain line in FIG. 1, FIG. 2 and FIG. 4. The face member f1 includes a base portion f11 that constitutes a face portion 4, and a backward extending portion f12 that extends backward from a peripheral edge of the base portion f11. The backward extending portion f12 includes a crown forming portion f13 that constitutes a part of a crown portion 6, and a sole forming portion f14 that constitutes a part of a sole portion 8.

The head 2 includes the face portion 4, the crown portion 6, the sole portion 8, and a hosel portion 10. The face portion 4 constitutes the front surface of the head 2. The face portion 4 includes a face outer surface 4*a* and a face inner surface 4*b*. The face outer surface 4*a* is a hitting face (face surface). The hitting face 4*a* has a face center Fc. The crown portion 6 includes a crown outer surface 6*a* and a crown inner surface 6*b*. The sole portion 8 includes a sole outer surface 8*a* and a sole inner surface 8*b*. The hosel portion 10 has a hosel hole 12.

The sole portion 8 extends to reach an outer edge 6*c* of the crown portion 6. The outer edge 6*c* of the crown portion 6 coincides with an outer edge 8*c* of the sole portion 8. The outer edge 8*c* of the sole portion 8 is also referred to as a sole outer edge. The sole portion in the present disclosure is defined as a sole portion that includes a so-called side portion (skirt portion).

As shown in FIG. 2, the sole portion 8 has a geometric center C1 thereof. The geometric center C1 is defined as a center of figure of the head 2 in the bottom view (FIG. 2). The geometric center C1 is a center of figure drawn by the contour line of the head 2. The bottom view of the head 2 is a projected figure obtained by projecting the bottom surface of the head 2 which is in the reference state onto a plane parallel to the ground plane HP. This projection is a vertical projection. The sole portion 8 has a position G1 of the center of gravity of the head (hereinafter also referred to as a head center-of-gravity position G1) that is obtained by projecting a center of gravity of the head CG (hereinafter also referred to as a head center of gravity CG) onto the sole portion 8. The head center-of-gravity position G1 is an intersection point between the sole outer surface 8*a* and a straight line that passes through the head center of gravity CG and extends in the up-down direction.

As shown in FIG. 2, the sole portion 8 includes a port 14. A badge, a weight, or the like can be attached to the port 14.

Figure 6:
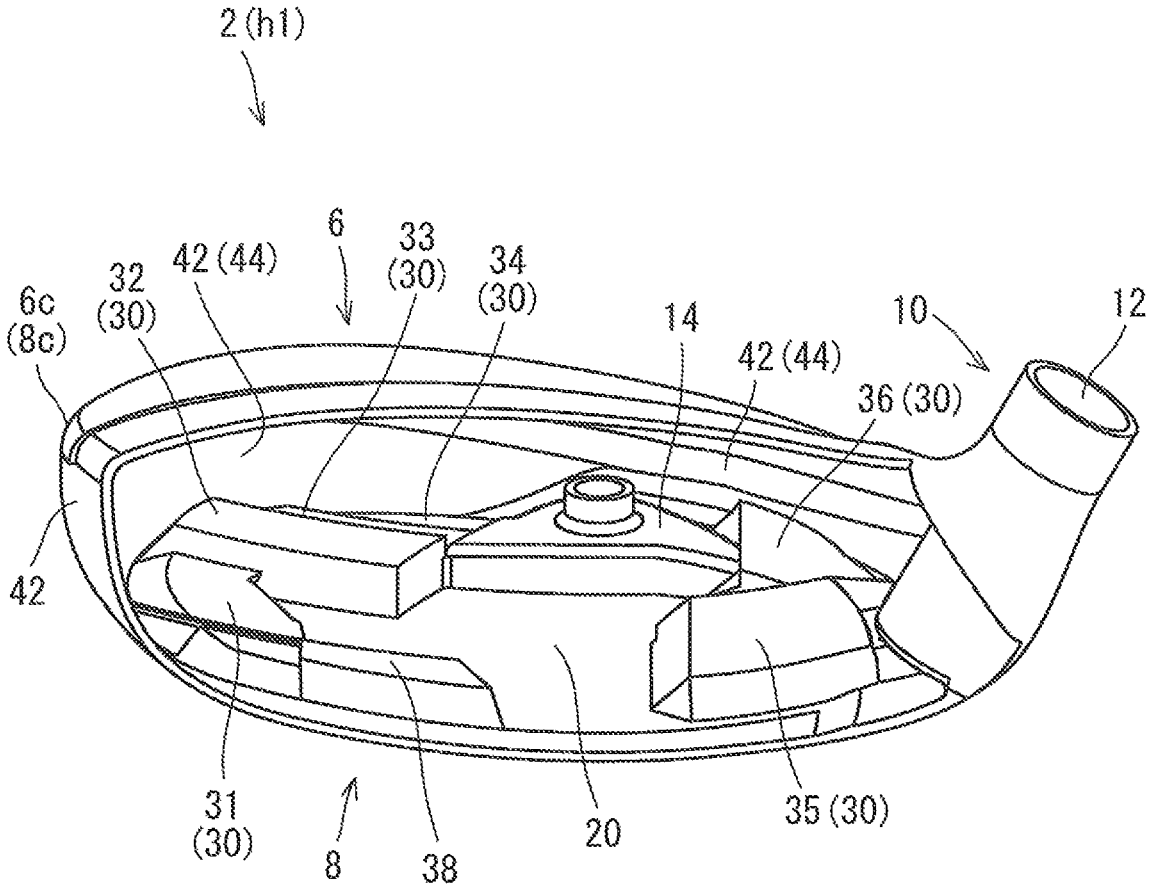
FIG. 6 is a perspective view of a head body of the golf club head in FIG. 1.

FIG. 6 is a perspective view of the head body h1. A recess and a projection are formed on the inner surface of the sole portion 8. The wall thickness of the sole portion 8 varies depending on the position of the sole portion 8. The wall thickness of the sole portion 8 can be measured in the direction of a line normal to the sole outer surface 8*a*. This direction of the normal line is determined at each measurement point of wall thickness.

Figure 7:
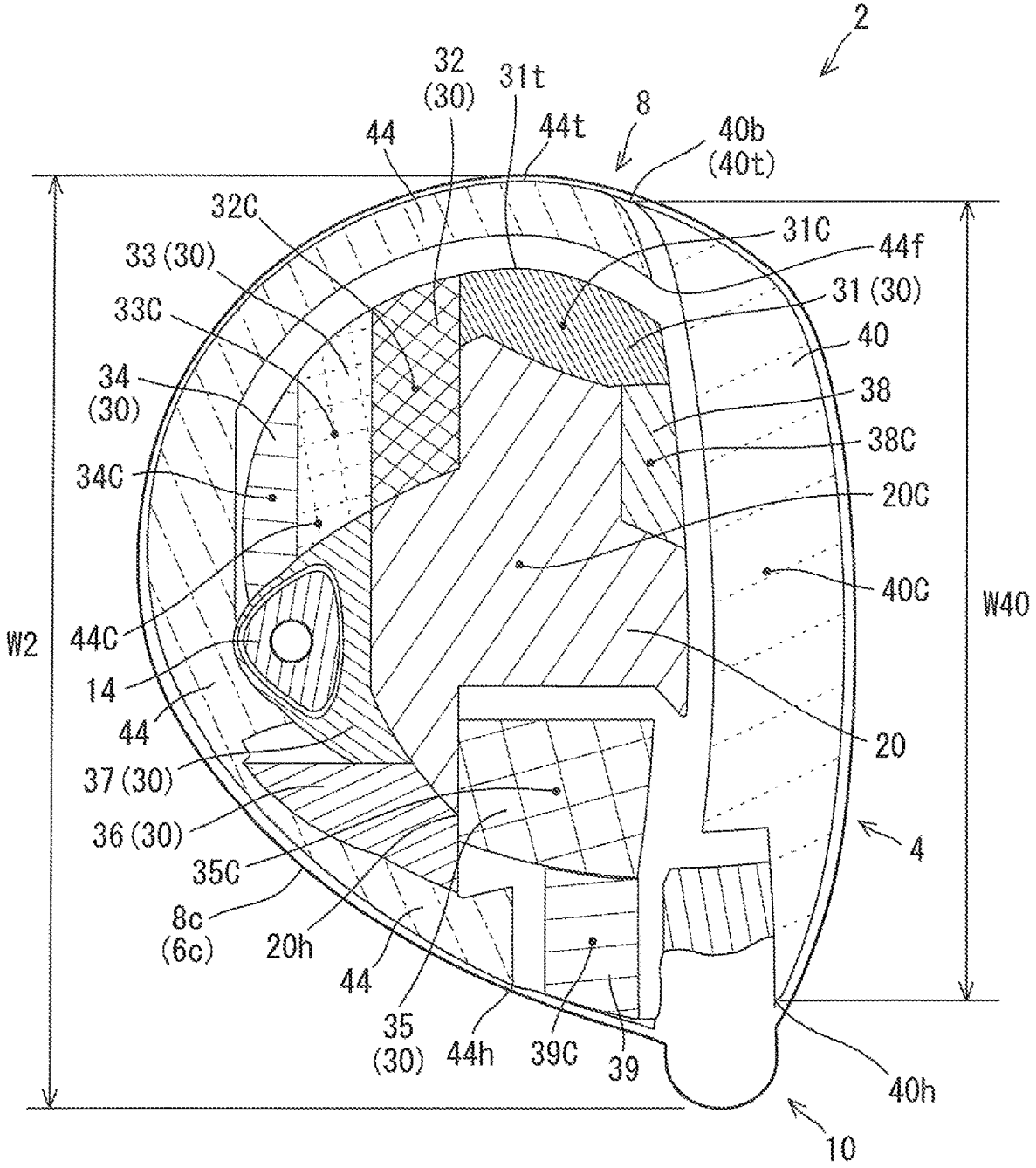
FIG. 7 is a bottom view of the golf club head in FIG. 1, and shows boundaries of regions (parts) of a sole portion.

FIG. 7 is the bottom view of the head 2 as with FIG. 2. FIG. 7 shows boundaries of regions (parts) of the sole portion 8, and these regions (parts) are indicated by different hatchings.

The sole portion 8 includes a center thin-wall part 20. The center thin-wall part 20 is formed over a region that includes the geometric center C1 (see FIG. 2). The center thin-wall part 20 is formed over a region that includes the head center-of-gravity position G1 (see FIG. 2). The center thin-wall part 20 is formed over a region that includes the position of the face center Fc in the toe-heel direction. The center thin-wall part 20 does not reach the outer edge 8*c* of the sole portion 8.

The sole portion 8 includes an outer thick-wall part 30. The outer thick-wall part 30 is formed on a sole outer edge side of the center thin-wall part 20. The outer thick-wall part 30 is formed around the center thin-wall part 20. The wall thickness of the outer thick-wall part 30 is greater than the wall thickness of the center thin-wall part 20. The minimum wall thickness of the outer thick-wall part 30 is greater than the wall thickness of the center thin-wall part 20. The outer thick-wall part 30 does not reach the outer edge 8*c* of the sole portion 8. The wall thickness of the outer thick-wall part 30 is greater than the wall thickness of a face vicinity part 40 (described below).

The center thin-wall part 20 has a geometric center 20C thereof. The geometric center 20C is determined in the bottom view of the head 2.

The outer thick-wall part 30 includes a first thick-wall part 31. The first thick-wall part 31 is formed over a region that includes the position of the head center of gravity CG in the face-back direction. The first thick-wall part 31 is positioned on the toe side of the center thin-wall part 20. The first thick-wall part 31 is partly bounded by the center thin-wall part 20. The entirety of the first thick-wall part 31 is positioned on the toe side with respect to the head center of gravity CG.

The first thick-wall part 31 has a geometric center 31C thereof. The geometric center 31C is determined in the bottom view of the head 2. The geometric center 31C is positioned on the toe side with respect to the geometric center 20C.

The outer thick-wall part 30 includes a second thick-wall part 32. The second thick-wall part 32 is positioned on the back side of the first thick-wall part 31. The second thick-wall part 32 is partly bounded by the first thick-wall part 31.

That is, the second thick-wall part 32 is contiguous with the first thick-wall part 31. The second thick-wall part 32 does not have to be contiguous with the first thick-wall part 31. The second thick-wall part 32 is partly bounded by the center thin-wall part 20. The wall thickness of the second thick-wall part 32 is greater than the wall thickness of the first thick-wall part 31. The entirety of the second thick-wall part 32 is positioned on the back side with respect to the head center of gravity CG. The entirety of the second thick-wall part 32 is positioned on the toe side with respect to the head center of gravity CG.

The second thick-wall part 32 has a geometric center 32C thereof. The geometric center 32C is determined in the bottom view of the head 2. The geometric center 32C is positioned on the back side with respect to the geometric center 31C. The geometric center 32C is positioned on the heel side with respect to the geometric center 31C. The geometric center 32C is positioned on the toe side with respect to the geometric center 20C. The geometric center 32C is positioned on the back side with respect to the head center of gravity CG. The geometric center 32C is positioned on the toe side with respect to the head center of gravity CG.

The outer thick-wall part 30 includes a third thick-wall part 33. The third thick-wall part 33 is positioned on the back side of the second thick-wall part 32. The third thick-wall part 33 is partly bounded by the second thick-wall part 32. The third thick-wall part 33 does not share a boundary with the center thin-wall part 20. The wall thickness of the third thick-wall part 33 is smaller than the wall thickness of the second thick-wall part 32. The entirety of the third thick-wall part 33 is positioned on the back side with respect to the head center of gravity CG.

The third thick-wall part 33 has a geometric center 33C thereof. The geometric center 33C is determined in the bottom view of the head 2. The geometric center 33C is positioned on the back side with respect to the geometric center 32C. The geometric center 33C is positioned on the heel side with respect to the geometric center 32C. The geometric center 33C is positioned on the toe side with respect to the geometric center 20C. The geometric center 33C is positioned on the back side with respect to the head center of gravity CG.

The outer thick-wall part 30 includes a fourth thick-wall part 34. The fourth thick-wall part 34 is positioned on the back side of the third thick-wall part 33. The fourth thick-wall part 34 is partly bounded by the third thick-wall part 33. The fourth thick-wall part 34 does not share a boundary with the center thin-wall part 20. The wall thickness of the fourth thick-wall part 34 is smaller than the wall thickness of the third thick-wall part 33. The entirety of the fourth thick-wall part 34 is positioned on the back side with respect to the head center of gravity CG.

The fourth thick-wall part 34 has a geometric center 34C thereof. The geometric center 34C is determined in the bottom view of the head 2. The geometric center 34C is positioned on the back side with respect to the geometric center 33C. The geometric center 34C is positioned on the heel side with respect to the geometric center 33C. The geometric center 34C is positioned on the toe side with respect to the geometric center 20C.

The outer thick-wall part 30 includes a fifth thick-wall part 35. The fifth thick-wall part 35 is positioned on the heel side of the center thin-wall part 20. The center thin-wall part 20 is formed between the fifth thick-wall part 35 and the first thick-wall part 31. The fifth thick-wall part 35 is partly bounded by the center thin-wall part 20. The fifth thick-wall part 35 does not share a boundary with the first thick-wall part 31. The fifth thick-wall part 35 does not share a boundary with the second thick-wall part 32. The fifth thick-wall part 35 does not share a boundary with the third thick-wall part 33. The fifth thick-wall part 35 does not share a boundary with the fourth thick-wall part 34. The wall thickness of the fifth thick-wall part 35 is greater than the wall thickness of the first thick-wall part 31. The wall thickness of the fifth thick-wall part 35 is smaller than the wall thickness of the second thick-wall part 32. The wall thickness of the fifth thick-wall part 35 is greater than the wall thickness of the third thick-wall part 33. The entirety of the fifth thick-wall part 35 is positioned on the heel side with respect to the head center of gravity CG.

The fifth thick-wall part 35 has a geometric center 35C thereof. The geometric center 35C is determined in the bottom view of the head 2. The geometric center 35C is positioned on the heel side with respect to the geometric center 20C. The geometric center 35C is positioned on the face side with respect to the geometric center 20C. The geometric center 35C is positioned on the face side with respect to the geometric center 32C. The geometric center 35C is positioned in a region that includes the position of the head center of gravity CG in the face-back direction.

The outer thick-wall part 30 includes a sixth thick-wall part 36. The sixth thick-wall part 36 is positioned on the back side of the fifth thick-wall part 35. The sixth thick-wall part 36 is partly bounded by the center thin-wall part 20. The sixth thick-wall part 36 is partly bounded by the fifth thick-wall part 35. The sixth thick-wall part 36 is partly bounded by an outer peripheral thin-wall part 44. The entirety of the sixth thick-wall part 36 is positioned on the heel side with respect to the head center of gravity CG. The entirety of the sixth thick-wall part 36 is positioned on the back side with respect to the head center of gravity CG.

The outer thick-wall part 30 includes a seventh thick-wall part 37. The seventh thick-wall part 37 is positioned on the toe side of the sixth thick-wall part 36. The seventh thick-wall part 37 is positioned on the back side of the center thin-wall part 20. The seventh thick-wall part 37 is positioned between the sixth thick-wall part 36 and the third thick-wall part 33. The seventh thick-wall part 37 is partly bounded by the sixth thick-wall part 36. The seventh thick-wall part 37 is partly bounded by the third thick-wall part 33. The seventh thick-wall part 37 is partly bounded by the center thin-wall part 20.

The sole portion 8 includes a front thick-wall part 38. The wall thickness of the front thick-wall part 38 is greater than the wall thickness of the center thin-wall part 20. The wall thickness of the front thick-wall part 38 is greater than the wall thickness of the face vicinity part 40. The wall thickness of the front thick-wall part 38 is greater than the wall thickness of the first thick-wall part 31. The front thick-wall part 38 is positioned between the center thin-wall part 20 and the face vicinity part 40. The front thick-wall part 38 is positioned on the heel side of the first thick-wall part 31. The front thick-wall part 38 is partly bounded by the center thin-wall part 20. The front thick-wall part 38 is partly bounded by the first thick-wall part 31. The front thick-wall part 38 has a geometric center 38C thereof. The geometric center 38C is positioned on the toe side with respect to the geometric center 20C. The geometric center 38C is positioned on the heel side with respect to the geometric center 31C. The geometric center 38C is positioned on the toe side with respect to the head center of gravity CG.

The sole portion 8 includes a heel thick-wall part 39. The wall thickness of the heel thick-wall part 39 is greater than the wall thickness of the center thin-wall part 20. The wall thickness of the heel thick-wall part 39 is greater than the wall thickness of the face vicinity part 40. The wall thickness of the heel thick-wall part 39 is greater than the wall thickness of the first thick-wall part 31. The heel thick-wall part 39 is positioned on the heel side of the fifth thick-wall part 35. The heel thick-wall part 39 is positioned between the fifth thick-wall part 35 and the outer edge 8*c*. The entirety of the heel thick-wall part 39 is positioned on the heel side with respect to the head center of gravity CG. The heel thick-wall part 39 is positioned on the face side of a heel-most point 44*h* of the outer peripheral thin-wall part 44.

The sole portion 8 includes the face vicinity part 40. The face vicinity part 40 extends along the face portion 4. The face vicinity part 40 is contiguous with the face portion 4. The face vicinity part 40 is formed between the center thin-wall part 20 and the face portion 4. The face vicinity part 40 is formed between the outer thick-wall part 30 and the face portion 4. The face vicinity part 40 is formed between the first thick-wall part 31 and the face portion 4. The face vicinity part 40 is formed between the fifth thick-wall part 35 and the face portion 4.

A part of the face vicinity part 40 (a part positioned close to the face portion 4) is constituted by the sole forming portion f14 of the face member f1.

The face vicinity part 40 has a geometric center thereof. The geometric center 40C is determined in the bottom view of the head 2. A distance in the toe-heel direction between the geometric center 40C and the geometric center C1 is less than or equal to 10 mm. A distance in the toe-heel direction between the geometric center 40C and the face center Fc is less than or equal to 10 mm. The geometric center 40C is positioned on the heel side with respect to the geometric center 31C. The geometric center 40C is positioned on the toe side with respect to the geometric center 35C.

The face vicinity part 40 has a back-most point 40*b*. The point 40*b* is positioned on the face side with respect to the geometric center 20C. The point 40*b* is positioned on the face side with respect to the geometric center 31C. The point 40*b* is positioned on the face side with respect to the geometric center 35C. The face vicinity part 40 has a toe-most point 40*t*. The point 40*t* is positioned on the toe side with respect to the geometric center 31C. The point 40*t* coincides with the point 40*b*. The face vicinity part 40 has a heel-most point 40*h*. The point 40*h* is positioned on the heel side with respect to the geometric center 35C.

A double-pointed arrow W40 in FIG. 7 shows a width of the face vicinity part 40 in the toe-heel direction. This width W40 is a distance in the toe-heel direction between the point 40*t* and the point 40*h*. A double-pointed arrow W2 in FIG. 7 shows a width of the head 2 in the toe-heel direction. From the viewpoint of advantageous effects (to be described later) brought by the face vicinity part 40, a ratio (W40/W2) can be set to be greater than or equal to 0.76, further set to be greater than or equal to 0.79, and even set to be greater than or equal to 0.82. Considering a restriction in head shape, the ratio (W40/W2) can be set to be less than or equal to 0.92, further set to be less than or equal to 0.89, and even set to be less than or equal to 0.86.

The wall thickness of the face vicinity part 40 is smaller than the wall thickness of the center thin-wall part 20. Such a thin face vicinity part 40 increases the deflection of the face portion 4 at impact with a ball and contributes to improvement in rebound performance. The thin face vicinity part 40 enhances rebound performance particularly when the head 2 hits a ball at a lower position of the hitting face 4*a*. From the viewpoint of strength, a preferable lower limit value can be set for the wall thickness of the face vicinity part 40.

Note that, alternatively, the wall thickness of the face vicinity part 40 may be greater than the wall thickness of the center thin-wall part 20. Such a thick face vicinity part 40 contributes to increase in the moment of inertia of the head 2. Such a thick face vicinity part 40 also contributes to improvement in durability of the head 2.

The sole portion 8 includes a rising portion 42 (see FIG. 5 and FIG. 6). The rising portion 42 extends such that it goes upward as its proximity to the outer edge 8*c* of the sole portion 8 increases. The rising portion 42 extends to reach the outer edge 8*c* of the sole portion 8. The rising portion 42 is positioned contiguous with the outer edge 8*c* of the sole portion 8. The outer peripheral thin-wall part 44 extends along the outer edge 8*c* of the sole portion 8. The rising portion 42 is formed on the sole outer edge side of the outer thick-wall part 30. The rising portion 42 is formed around the outer thick-wall part 30. The rising portion 42 is may be a so-called side portion or skirt portion.

The rising portion 42 includes the outer peripheral thin-wall part 44 that has a wall thickness thinner than that of the outer thick-wall part 30. The outer peripheral thin-wall part 44 is formed on the sole outer edge side of the outer thick-wall part 30. The outer peripheral thin-wall part 44 is formed around the outer thick-wall part 30. The outer peripheral thin-wall part 44 extends along the outer edge 8*c* of the sole portion 8. The outer peripheral thin-wall part 44 is positioned contiguous with the outer edge 8*c* of the sole portion 8. The outer peripheral thin-wall part 44 continuously extends from the toe side of the first thick-wall part 31, through the back side of the fourth thick-wall part 34, to the heel side of the fifth thick-wall part 35. The outer peripheral thin-wall part 44 has a toe-most point 44*t* and the heel-most point 44*h*. The point 44*t* is positioned on the toe side with respect to the point 40*t*. The point 44*t* is positioned on the toe side with respect to the geometric center 31C. The point 44*t* is positioned on the toe side with respect to a toe-most point 31*t* of the first thick-wall part 31. The point 44*h* is positioned on the heel side with respect to the geometric center 35C. The point 44*h* is positioned on the heel side with respect to a heel-most point 20*h* of the center thin-wall part 20. The point 44*h* is positioned on the face side with respect to the geometric center 32C. The outer peripheral thin-wall part 44 includes a face-most point 44*f*. The point 44*f* is positioned on the face side with respect to the geometric center 31C. The point 44*f* is positioned on the back side with respect to the geometric center 40C. The point 44*f* is positioned on the toe side with respect to the geometric center 31C.

The outer peripheral thin-wall part 44 has a geometric center 44C thereof. The geometric center 44C is determined in the bottom view of the head 2. Because of the shape (substantially C-shape) of the outer peripheral thin-wall part 44, the geometric center 44C is positioned outside the outer peripheral thin-wall part 44. The geometric center 44C is positioned in the outer thick-wall part 30. Alternatively, the geometric center 44C may be positioned in the center thin-wall part 20.

Such a head 2 exhibits the following advantageous effects.

The center thin-wall part 20 is thinner than the outer thick-wall part 30. The outer thick-wall part 30 is formed on the sole outer edge side of the center thin-wall part 20, whereby the lateral moment of inertia of the head 2 is effectively increased. In addition, in the outer thick-wall part 30, the second thick-wall part 32 which is positioned on the back side with respect to the head center of gravity CG has a wall thickness thicker than that of the first thick-wall part 31, whereby an up-down moment of inertia of the head 2 is effectively increased. The lower limit value of the wall thickness of the center thin-wall part 20 can be set from the viewpoint of head strength.

The lateral moment of inertia means a moment of inertia of a head about an axis that passes through the head center of gravity CG and is parallel to the up-down direction. The up-down moment of inertia means a moment of inertia of a head about an axis that passes through the head center of gravity CG and is parallel to the toe-heel direction.

The outer peripheral thin-wall part 44 is thinner than the outer thick-wall part 30. The outer peripheral thin-wall part 44 is thinner than the minimum wall thickness of the outer thick-wall part 30. The rising portion 42 is made thin by the presence of the outer peripheral thin-wall part 44, which prevents the head center of gravity CG from being located at a higher position (lower center-of-gravity effect). A head tends to hit a ball at a lower position of the hitting face 4*a* when the ball is placed directly on the ground. The head center of gravity CG which is set at a lower position improves rebound performance when the head hits a ball at a lower position of the hitting face 4*a*. This advantageous effect is particularly effective for fairway wood type heads and hybrid type heads.

The outer peripheral thin-wall part 44 is thinner than the center thin-wall part 20. The outer peripheral thin-wall part 44 is thinner than the face vicinity part 40. For these reasons, the lower center-of-gravity effect is further enhanced.

At a position of the head center of gravity CG in the toe-heel direction, the outer peripheral thin-wall part 44 is positioned on the back side with respect to the outer thick-wall part 30. The outer peripheral thin-wall part 44 reduces a depth D1 of the center of gravity (see FIG. 2, hereinafter also referred to as center-of-gravity depth D1), and can lower the position of a sweet spot.

The second thick-wall part 32 (geometric center 32C) is positioned on the toe side and back side with respect to the head center of gravity CG. The second thick-wall part 32 is thicker than the first thick-wall part 31. The first thick-wall part 31 and the second thick-wall part 32 equally contribute to the lateral moment of inertia. On the other hand, since the second thick-wall part 32 is located apart from the head center of gravity CG toward the back side as compared with the first thick-wall part 31, the second thick-wall part 32 makes a greater contribution to the up-down moment of inertia than the first thick-wall part 31. When the second thick-wall part 32 is thicker than the first thick-wall part 31, the up-down moment of inertia can be effectively increased.

The third thick-wall part 33 is positioned on the back side with respect to the second thick-wall part 32. The third thick-wall part 33 is contiguous with the back side of the second thick-wall part 32. Alternatively, the third thick-wall part 33 does not have to be contiguous with the second thick-wall part 32. The third thick-wall part 33 is thicker than the first thick-wall part 31. For this reason, increased weight is distributed to the back side with respect to the head center of gravity CG, which increases the up-down moment of inertia.

The third thick-wall part 33 is thinner than the second thick-wall part 32. The increase of the center-of-gravity depth D1 (see FIG. 2) is suppressed by the third thick-wall part 33 thinner than the second thick-wall part 32. The center-of-gravity depth D1 is a distance in the face-back direction between the front-most point of the face portion 4 and the head center of gravity CG. A smaller center-of-gravity depth D1 can lower the position of the sweet spot. Note that the sweet spot means an intersection point between the hitting face 4*a* and a straight line that passes through the head center of gravity CG and is perpendicular to the hitting face 4*a*. Since the head 2 has a loft angle, the smaller the center-of-gravity depth D1 is, the lower the position of the sweet spot is. A lower sweet spot improves rebound performance when the head hits a ball at a lower position of the hitting face 4*a*. This advantageous effect is particularly effective for fairway wood type heads and hybrid type heads which have many opportunities to hit a ball that is placed directly on the ground.

The fourth thick-wall part 34 which is positioned on the back side of the third thick-wall part 33 is thinner than the third thick-wall part 33. For this reason, the center-of-gravity depth D1 is further reduced and the sweet spot is lowered. The fourth thick-wall part 34 is thinner than the first thick-wall part 31. For this reason, the center-of-gravity depth D1 is reduced and the sweet spot can be lowered.

The fifth thick-wall part 35 (geometric center 35C) is positioned on the heel side with respect to the head center of gravity CG. The fifth thick-wall part 35 increases the lateral moment of inertia. The geometric center 35C is positioned on the face side with respect to the geometric center 20C. By making the fifth thick-wall part 35 thick, the center-of-gravity depth D1 is reduced and the position of the sweet spot is lowered. The front thick-wall part 38 positioned on the face side with respect to the head center of gravity CG reduces the center-of-gravity depth D1 and lowers the position of the sweet spot. The heel thick-wall part 39 positioned on the heel side with respect to the fifth thick-wall part 35 further enhances the lateral moment of inertia.

From the viewpoints of advantageous effects described above, preferable wall thicknesses of the respective parts and preferable ratios between wall thicknesses of the parts are as follows.

The wall thickness of the center thin-wall part 20 is preferably greater than or equal to 0.8 mm, more preferably greater than or equal to 1.0 mm, and still more preferably greater than or equal to 1.2 mm. The wall thickness of the center thin-wall part 20 is preferably less than or equal to 1.6 mm, more preferably less than or equal to 1.5 mm, and still more preferably less than or equal to 1.4 mm.

The wall thickness of the outer thick-wall part 30 is preferably greater than or equal to 2.4 mm, more preferably greater than or equal to 2.5 mm, and still more preferably greater than or equal to 2.6 mm. The wall thickness of the outer thick-wall part 30 is preferably less than or equal to 6.5 mm, more preferably less than or equal to 6.4 mm, and still more preferably less than or equal to 6.3 mm.

The wall thickness of the first thick-wall part 31 is preferably greater than or equal to 2.8 mm, more preferably greater than or equal to 3.0 mm, and still more preferably greater than or equal to 3.2 mm. The wall thickness of the first thick-wall part 31 is preferably less than or equal to 3.6 mm, more preferably less than or equal to 3.5 mm, and still more preferably less than or equal to 3.4 mm.

The wall thickness of the second thick-wall part 32 is preferably greater than or equal to 3.3 mm, more preferably greater than or equal to 3.5 mm, and still more preferably greater than or equal to 3.7 mm. The wall thickness of the second thick-wall part 32 is preferably less than or equal to 6.7 mm, more preferably less than or equal to 6.5 mm, and still more preferably less than or equal to 6.3 mm.

The wall thickness of the third thick-wall part 33 is preferably greater than or equal to 2.7 mm, more preferably greater than or equal to 2.9 mm, and still more preferably greater than or equal to 3.1 mm. The wall thickness of the third thick-wall part 33 is preferably less than or equal to 4.3 mm, more preferably less than or equal to 4.1 mm, and still more preferably less than or equal to 3.9 mm.

The wall thickness of the fourth thick-wall part 34 is preferably greater than or equal to 2.4 mm, more preferably greater than or equal to 2.5 mm, and still more preferably greater than or equal to 2.6 mm. The wall thickness of the fourth thick-wall part 34 is preferably less than or equal to 3.0 mm, more preferably less than or equal to 2.9 mm, and still more preferably less than or equal to 2.8 mm.

The wall thickness of the fifth thick-wall part 35 is preferably greater than or equal to 3.1 mm, more preferably greater than or equal to 3.3 mm, and still more preferably greater than or equal to 3.5 mm. The wall thickness of the fifth thick-wall part 35 is preferably less than or equal to 4.6 mm, more preferably less than or equal to 4.4 mm, and still more preferably less than or equal to 4.2 mm.

The wall thickness of the front thick-wall part 38 is preferably greater than or equal to 2.7 mm, more preferably greater than or equal to 2.9 mm, and still more preferably greater than or equal to 3.1 mm. The wall thickness of the front thick-wall part 38 is preferably less than or equal to 4.6 mm, more preferably less than or equal to 4.4 mm, and still more preferably less than or equal to 4.2 mm.

The wall thickness of the heel thick-wall part 39 is preferably greater than or equal to 3.0 mm, more preferably greater than or equal to 3.2 mm, and still more preferably greater than or equal to 3.4 mm. The wall thickness of the heel thick-wall part 39 is preferably less than or equal to 4.3 mm, more preferably less than or equal to 4.1 mm, and still more preferably less than or equal to 3.9 mm.

The wall thickness of the face vicinity part 40 is preferably greater than or equal to 0.75 mm, more preferably greater than or equal to 0.80 mm, and still more preferably greater than or equal to 0.85 mm. The wall thickness of the face vicinity part 40 is preferably less than or equal to 1.20 mm, more preferably less than or equal to 1.10 mm, and still more preferably less than or equal to 1.00 mm.

The wall thickness of the outer peripheral thin-wall part 44 is preferably greater than or equal to 0.55 mm, more preferably greater than or equal to 0.60 mm, and still more preferably greater than or equal to 0.65 mm. The wall thickness of the outer peripheral thin-wall part 44 is preferably less than or equal to 1.00 mm, more preferably less than or equal to 0.90 mm, and still more preferably less than or equal to 0.80 mm.

The wall thickness of the first thick-wall part 31 is denoted by T31, and the wall thickness of the second thick-wall part 32 is denoted by T32. T32/T31 is preferably greater than or equal to 1.1, more preferably greater than or equal to 1.3, and still more preferably greater than or equal to 1.5. T32/T31 is preferably less than or equal to 2.3, more preferably less than or equal to 2.1, and still more preferably less than or equal to 1.9.

The wall thickness of the third thick-wall part 33 is denoted by T33, and the wall thickness of the second thick-wall part 32 is denoted by T32. T32/T33 is preferably greater than or equal to 1.1, more preferably greater than or equal to 1.3, and still more preferably greater than or equal to 1.5. T32/T33 is preferably less than or equal to 2.1, more preferably less than or equal to 1.9, and still more preferably less than or equal to 1.7.

The wall thickness of the center thin-wall part 20 is denoted by T20, and the wall thickness of the outer thick-wall part 30 is denoted by T30. T20/T30 is preferably greater than or equal to 0.17, more preferably greater than or equal to 0.19, and still more preferably greater than or equal to 0.21. T20/130 is preferably less than or equal to 0.53, more preferably less than or equal to 0.51, and still more preferably less than or equal to 0.49.

The wall thickness of the outer peripheral thin-wall part 44 is denoted by T44, and the wall thickness of the outer thick-wall part 30 is denoted by T30. T44/T30 is preferably greater than or equal to 0.08, more preferably greater than or equal to 0.09, and still more preferably greater than or equal to 0.10. T44/T30 is preferably less than or equal to 0.36, more preferably less than or equal to 0.32, and still more preferably less than or equal to 0.28.

Figure 8:
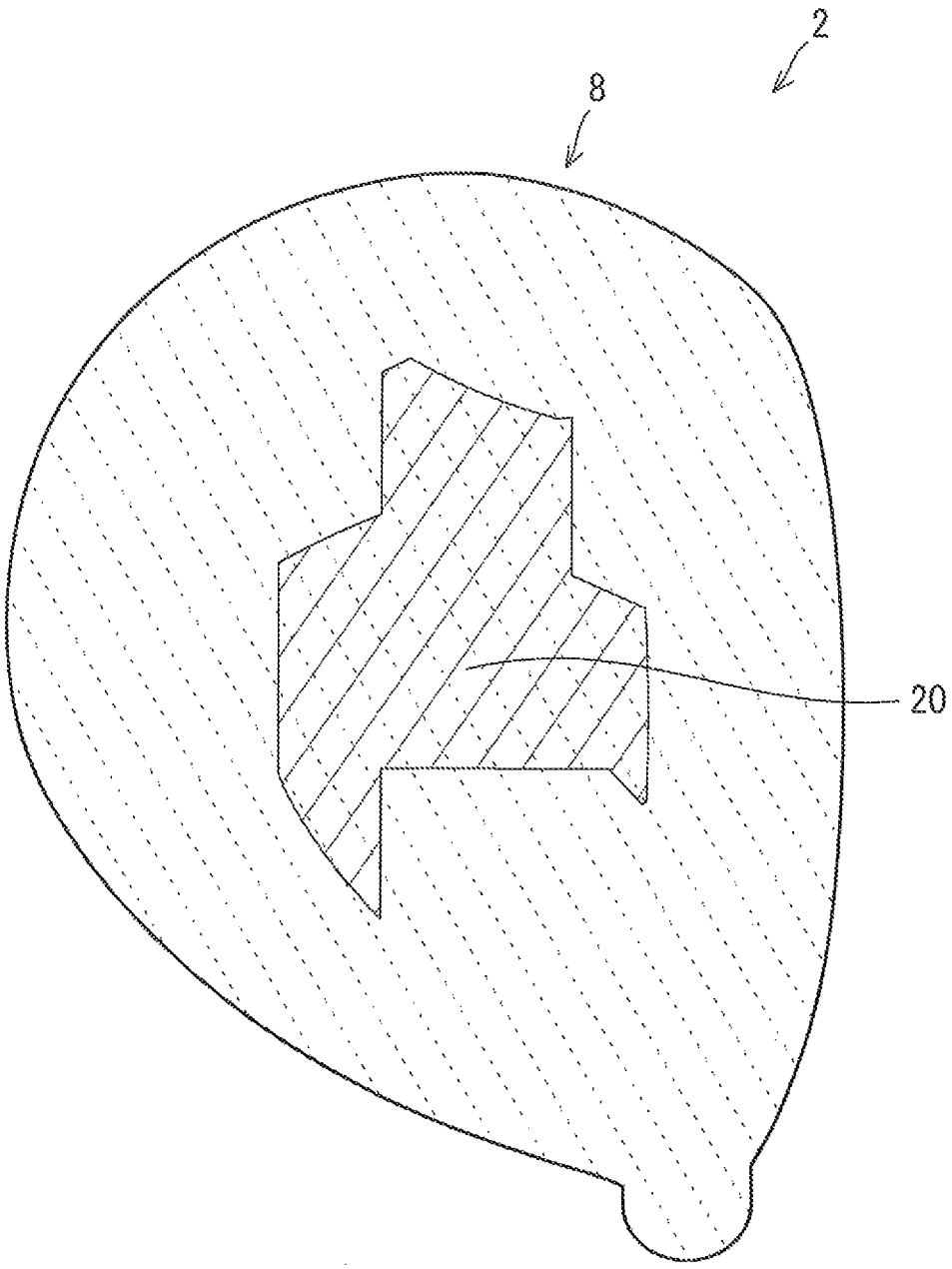
FIG. 8 is the same bottom view as FIG. 7, and in FIG. 8, a projected area of the head is indicated by broken line hatching, and a projected area of a center thin-wall part is indicated by solid line hatching.

As with FIG. 2 and FIG. 7, FIG. 8 is the bottom view of the head 2. The projected area of the head 2 is determined in the bottom view. The projected area of the head 2 is the area of a region indicated with dushed-line hatching in FIG. 8. The projected area of the center thin-wall part 20 is determined in the bottom view. The projected area of the center thin-wall part 20 is the area of a region indicated with solid-line hatching in FIG. 8.

From the viewpoint of advantageous effects brought by the center thin-wall part 20, a ratio of the projected area of the center thin-wall part 20 to the projected area of the head 2 is preferably greater than or equal to 10%, more preferably greater than or equal to 12%, and still more preferably greater than or equal to 14%. From the viewpoint of providing the outer thick-wall part 30 and the outer peripheral thin-wall part 44, the ratio of the projected area of the center thin-wall part 20 to the projected area of the head 2 is preferably less than or equal to 22%, more preferably less than or equal to 20%, and still more preferably less than or equal to 18%.

A double-pointed arrow D2 in FIG. 2 shows a width of the head 2 in the face-back direction. The width D2 is a distance in the face-back direction between the front-most point of the head 2 and the rear-most point of the head 2. From the viewpoint of lowering the position of the sweet spot and enhancing rebound performance when the head hits a ball at a lower position of the hitting face 4*a*, D1/D2 is preferably less than or equal to 0.50, more preferably less than or equal to 0.45, and still more preferably less than or equal to 0.42. Considering a restriction in design, D1/D2 is preferably greater than or equal to 0.20, more preferably greater than or equal to 0.25, and still more preferably greater than or equal to 0.30.

As described above, preferable heads are fairway wood type heads and hybrid type heads which have many opportunities to hit a ball that is placed directly on the ground.

Examples of club numbers of fairway wood type heads include a number 3 wood (W #3), a number 4 wood (W #4), a number 5 wood (W #5), a number 7 wood (W #7), a number 9 wood (W #9), a number 11 wood (W #11), and a number 13 wood (W #13). Examples of structures of a normal fairway wood type head include the following structures (1a) to (1d):

(1a) curved hitting face;

(1b) hollow structure;

(1c) head volume of greater than or equal to 100 $cm^3$ and less than or equal to 200 $cm^3$; and (1d) real loft angle of greater than or equal to 14 degrees and less than or equal to 33 degrees.

Examples of club numbers of hybrid type heads include a number 3 hybrid (H3), a number 4 hybrid (H4), a number 5 hybrid (H5), and a number 6 hybrid (H6). Examples of structures of a normal hybrid type head include the following structures (2a) to (2d):

(2a) curved hitting face;

(2b) hollow structure;

(2c) head volume of greater than or equal to 90 $cm^3$ and less than or equal to 140 $cm^3$; and (2d) real loft angle of greater than or equal to degrees and less than or equal to 30 degrees.

The following clauses are a part of the present disclosure.

[Clause 1]

A golf club head including:

a face portion that includes a hitting face;

a sole portion;

a crown portion; and a hosel portion, wherein the sole portion includes a center thin-wall part that is formed over a region including a geometric center of the sole portion, and an outer thick-wall part that is formed on a sole outer edge side of the center thin-wall part and has a wall thickness greater than a wall thickness of the center thin-wall part, and the outer thick-wall part includes a first thick-wall part that is formed over a region including a position of a center of gravity of the golf club head in a face-back direction, and a second thick-wall part that is positioned on a back side of the first thick-wall part and has a wall thickness greater than a wall thickness of the first thick-wall part.

[Clause 2]

The golf club head according to clause 1, wherein the center thin-wall part is formed over a region that includes a head center-of-gravity position.

[Clause 3]

The golf club head according to clause 1 or 2, wherein the sole portion includes a rising portion that is formed on the sole outer edge side of the outer thick-wall part and extends such that the rising portion goes upward as its proximity to an outer edge of the crown portion increases, and the rising portion includes an outer peripheral thin-wall part that has a wall thickness thinner than the wall thickness of the outer thick-wall part.

[Clause 4]

The golf club head according to any one of clauses 1 to 3, wherein the outer thick-wall part further includes a third thick-wall part that is positioned on the back side of the second thick-wall part and has a wall thickness thinner than the wall thickness of the second thick-wall part.

[Clause 5]

The golf club head according to any one of clauses 1 to 4, wherein in a bottom view of the golf club head, a ratio of a projected area of the center thin-wall part to a projected area of the golf club head is greater than or equal to 10%.

LIST OF REFERENCE SYMBOLS

2 Golf club head
4 Face portion
4*a* Hitting face
6 Crown portion
8 Sole portion
10 Hosel portion
12 Hosel hole
20 Center thin-wall part
30 Outer thick-wall part
31 First thick-wall part
32 Second thick-wall part
33 Third thick-wall part
34 Fourth thick-wall part
35 Fifth thick-wall part
36 Sixth thick-wall part
37 Seventh thick-wall part
38 Front thick-wall part
39 Heel thick-wall part
40 Face vicinity part
42 Rising portion
44 Outer peripheral thin-wall part
h1 Head body
f1 Face member The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a face portion that includes a hitting face;

a sole portion, wherein a wall thickness of the sole portion is variable at different positions of the sole portion;

a crown portion; and a hosel portion, wherein the sole portion comprises:

a thin-wall part disposed at a central region of the sole portion, the central region including a geometric center of the sole portion, the geometric center of the sole portion being defined as a center of figure of the golf club head in a bottom view of the golf club head;

a thick-wall part disposed at an outer portion of the sole portion between the thin-wall part and an outer edge of the sole portion, a wall thickness of the thick-wall part being greater than a wall thickness of the thin-wall part; and a face vicinity part that is located between the thin-wall part and the face portion, that extends along the face portion, and that has a wall thickness smaller than the wall thickness of the thick-wall part, the thick-wall part extends continuously from a toe-side position relative to the thin-wall part, through a back-side position relative to the thin-wall part, to a heel-side position relative to the thin-wall part, the thick-wall part includes a gap at a face-side position relative to the thin-wall part, and the thin-wall part is connected to the face vicinity part at a position where the gap is located.

2. The golf club head according to claim 1, wherein the central region includes a center-of-gravity position at an intersection between an outer surface of the sole portion and a straight line that passes through a center of gravity of the golf club head and extends in an up-down direction of the golf club head.

3. The golf club head according to claim 1, wherein
the sole portion includes a rising portion that is formed on a sole outer edge side of the thick-wall part and extends such that the rising portion goes upward as its proximity to an outer edge of the crown portion increases, and
the rising portion includes an outer peripheral thin-wall part that has a wall thickness thinner than the wall thickness of the thick-wall part.

4. The golf club head according to claim 3, wherein
at a position of a center of gravity of the golf club head in a toe-heel direction, the outer peripheral thin-wall part is disposed rearward in a face-back direction with respect to the thick-wall part.

5. The golf club head according to claim 1, wherein
in the bottom view of the golf club head, a ratio of a projected area of the thin-wall part to a projected area of the golf club head is greater than or equal to 10% and less than or equal to 22%.

6. The golf club head according to claim 1, wherein
the thick-wall part includes a first thick-wall part that constitutes a portion of the thick-wall part, and a second thick-wall part that constitutes another portion of the thick-wall part,
the first thick-wall part is positioned on a toe side relative to a center of gravity of the golf club head,
the second thick-wall part is disposed rearward in a face-back direction relative to the first thick-wall part, and
a wall thickness of the second thick-wall part is greater than a wall thickness of the first thick-wall part.

7. The golf club head according to claim 6, wherein
the thick-wall part further includes a third thick-wall part that is disposed rearward in the face-back direction of the second thick-wall part and a wall thickness of the third thick-wall part is thinner than the wall thickness of the second thick-wall part.

8. The golf club head according to claim 7, wherein
the wall thickness of the third thick-wall part is thicker than the wall thickness of the first thick-wall part.

9. The golf club head according to claim 6, wherein
an entirety of the second thick-wall part is disposed rearward in the face-back direction with respect to the center of gravity of the golf club head.

10. The golf club head according to claim 6, wherein
the first thick-wall part is partly bounded by the thin-wall part.

11. The golf club head according to claim 6, wherein
a geometric center of the second thick-wall part is positioned on a toe side with respect to a geometric center of the thin-wall part.

12. A golf club head comprising:
a face portion that includes a hitting face;
a sole portion, wherein a wall thickness of the sole portion is variable at different positions of the sole portion;
a crown portion; and
a hosel portion, wherein
the sole portion comprises:
a thin-wall part disposed at a central region of the sole portion, the central region including a geometric center of the sole portion, the geometric center of the sole portion being defined as a center of figure of the golf club head in a bottom view of the golf club head;
a thick-wall part disposed at an outer portion of the sole portion between the thin-wall part and an outer edge of the sole portion, a wall thickness of the thick-wall part being greater than a wall thickness of the thin-wall part;
a face vicinity part that is located between the thin-wall part and the face portion, that extends along the face portion, and that has a wall thickness smaller than the wall thickness of the thick-wall part; and
a port,
the thick-wall part extends continuously from a toe-side position relative to the thin-wall part, through a back-side position relative to the thin-wall part, to a heel-side position relative to the thin-wall part,
the thick-wall part includes a gap at a face-side position relative to the thin-wall part, and
the thin-wall part is connected to the face vicinity part at a position where the gap is located.

13. The golf club head according to claim 12, wherein
the central region includes a center-of-gravity position at an intersection between an outer surface of the sole portion and a straight line that passes through a center of gravity of the golf club head and extends in an up-down direction of the golf club head.

14. The golf club head according to claim 12, wherein
the sole portion includes a rising portion that is formed on a sole outer edge side of the thick-wall part and extends such that the rising portion goes upward as its proximity to an outer edge of the crown portion increases, and
the rising portion includes an outer peripheral thin-wall part that has a wall thickness thinner than the wall thickness of the thick-wall part.

15. The golf club head according to claim 12, wherein
in the bottom view of the golf club head, a ratio of a projected area of the thin-wall part to a projected area of the golf club head is greater than or equal to 10% and less than or equal to 22%.

16. The golf club head according to claim 12, wherein
the thick-wall part includes a first thick-wall part that constitutes a portion of the thick-wall part, and a second thick-wall part that constitutes another portion of the thick-wall part,
the first thick-wall part is positioned on a toe side relative to a center of gravity of the golf club head,
the second thick-wall part is disposed rearward in a face-back direction relative to the first thick-wall part,
a wall thickness of the second thick-wall part is greater than a wall thickness of the first thick-wall part, and
the port is disposed rearward in the face-back direction relative to the second thick-wall part.

17. The golf club head according to claim 16, wherein
the thick-wall part further includes a third thick-wall part disposed rearward in the face-back direction of the second thick-wall part and a wall thickness of the third thick-wall part is thinner than the wall thickness of the second thick-wall part.

18. A golf club head formed by joining a face member to a head body, the golf club head comprising:
a face portion that includes a hitting face;
a sole portion, wherein a wall thickness of the sole portion is variable at different positions of the sole portion;
a crown portion; and
a hosel portion, wherein
the sole portion comprises:
a thin-wall part disposed at a central region of the sole portion, the central region including a geometric center of the sole portion, the geometric center of the sole portion being defined as a center of figure of the golf club head in a bottom view of the golf club head;

a thick-wall part disposed at an outer portion of the sole portion between the thin-wall part and an outer edge of the sole portion, a wall thickness of the thick-wall part being greater than a wall thickness of the thin-wall part; and a face vicinity part that is located between the thin-wall part and the face portion, that extends along the face portion, and that has a wall thickness smaller than the wall thickness of the thick-wall part, the thick-wall part extends continuously from a toe-side position relative to the thin-wall part, through a back-side position relative to the thin-wall part, to a heel-side position relative to the thin-wall part, the thick-wall part includes a gap at a face-side position relative to the thin-wall part, the thin-wall part is connected to the face vicinity part at a position where the gap is located, the face member comprises:

a base portion that constitutes a face portion; and a backward extending portion that extends backward from a peripheral edge of the base portion, the backward extending portion comprises:

a crown forming portion that constitutes a part of the crown portion; and a sole forming portion that constitutes a part of the sole portion.

19. The golf club head according to claim 18, wherein the central region includes a center-of-gravity position at an intersection between an outer surface of the sole portion and a straight line that passes through a center of gravity of the golf club head and extends in an up-down direction of the golf club head.

20. The golf club head according to claim 18, wherein the sole portion includes a rising portion that is formed on a sole outer edge side of the thick-wall part and extends such that the rising portion goes upward as its proximity to an outer edge of the crown portion increases, and the rising portion includes an outer peripheral thin-wall part that has a wall thickness thinner than the wall thickness of the thick-wall part.

21. The golf club head according to claim 18, wherein the thick-wall part includes: a first thick-wall part that constitutes a portion of the thick-wall part; a second thick-wall part that constitutes another portion of the thick-wall part; and a third thick-wall part that constitutes yet another portion of the thick-wall part, the first thick-wall part is positioned on a toe side relative to a center of gravity of the golf club head, the second thick-wall part is disposed rearward in a face-back direction relative to the first thick-wall part, a wall thickness of the second thick-wall part is greater than a wall thickness of the first thick-wall part, the third thick-wall part is disposed rearward in the face-back direction of the second thick-wall part, and a wall thickness of the third thick-wall part is thinner than the wall thickness of the second thick-wall part.

22. The golf club head according to claim 18, wherein in the bottom view of the golf club head, a ratio of a projected area of the thin-wall part to a projected area of the golf club head is greater than or equal to 10% and less than or equal to 22%.

* * * * *